US011193724B1

(12) United States Patent
McCarthy

(10) Patent No.: US 11,193,724 B1
(45) Date of Patent: Dec. 7, 2021

(54) HYBRID PISTOL FRAME KIT FOR RECEIVING FIREARM PARTS AND ACCESSORIES

(71) Applicant: Brent McCarthy, Summerville, SC (US)

(72) Inventor: Brent McCarthy, Summerville, SC (US)

( * ) Notice: Subject to any disclaimer, the term of this patent is extended or adjusted under 35 U.S.C. 154(b) by 0 days.

(21) Appl. No.: 17/078,707

(22) Filed: Oct. 23, 2020

(51) Int. Cl.

| | |
|---|---|
| ***F41A 3/66*** | (2006.01) |
| ***F41C 23/10*** | (2006.01) |
| ***F41C 23/04*** | (2006.01) |
| ***F41A 19/11*** | (2006.01) |
| ***F41C 27/00*** | (2006.01) |
| ***F41C 23/12*** | (2006.01) |

(52) U.S. Cl.
CPC ..... *F41A 3/66* (2013.01); *F41A 19/11* (2013.01); *F41C 23/04* (2013.01); *F41C 23/10* (2013.01); *F41C 23/12* (2013.01); *F41C 27/00* (2013.01)

(58) Field of Classification Search
CPC ..... F41A 3/66; F41C 23/10; F41C 23/12
USPC ..... 42/71.02
See application file for complete search history.

(56) References Cited

U.S. PATENT DOCUMENTS

| | | | | |
|---|---|---|---|---|
| 1,340,127 | A * | 5/1920 | Welch | F41C 23/12 42/71.01 |
| 3,711,980 | A * | 1/1973 | Palama' | F41C 23/10 42/16 |
| 4,463,654 | A | 8/1984 | Barnes et al. | |
| 5,272,957 | A | 12/1993 | Chesnut et al. | |
| 7,216,450 | B2 | 5/2007 | Pikielny | |
| 7,506,469 | B2 | 5/2009 | Poulin et al. | |
| 7,802,392 | B2 | 9/2010 | Peterson et al. | |
| 7,926,217 | B2 | 4/2011 | McCann | |
| 8,230,632 | B2 | 7/2012 | Moretti | |
| 8,429,844 | B2 | 4/2013 | Dextraze et al. | |
| 8,448,366 | B2 | 5/2013 | Faifer | |
| 8,656,622 | B2 | 2/2014 | Peterson et al. | |
| D702,308 | S | 4/2014 | Glock | |
| 8,820,212 | B2 | 9/2014 | Rostocil | |
| D742,985 | S | 11/2015 | Hudson, III | |
| 9,239,203 | B2 | 1/2016 | Jarboe et al. | |
| 9,677,846 | B1 | 6/2017 | Vankeuren, III | |
| D803,341 | S | 11/2017 | Wolf | |
| 10,184,737 | B2 | 1/2019 | Roberts | |
| D859,565 | S | 9/2019 | Oglesby | |
| D865,106 | S | 10/2019 | Oglesby | |
| D870,228 | S | 12/2019 | Jager | |
| 10,612,870 | B2 | 4/2020 | Borges et al. | |
| 10,641,567 | B2 | 5/2020 | Weilharter | |
| 10,718,578 | B2 | 7/2020 | Partington | |
| D894,314 | S | 8/2020 | Noonan et al. | |
| D894,315 | S | 8/2020 | Noonan et al. | |
| 10,731,936 | B1 | 8/2020 | Sapio et al. | |
| 10,739,090 | B2 | 8/2020 | Borges et al. | |

(Continued)

OTHER PUBLICATIONS

Screen shot of www.polymer80.com; 1 page.
Screen shot of www.80percentarms.com/; 1 page.

*Primary Examiner* — Reginald S Tillman, Jr.
(74) *Attorney, Agent, or Firm* — Thrive IP; Bernard S. Klosowski

(57) ABSTRACT

Systems and processes are provided for prefabricating pistol frames to re-purpose original pistol components, produce pistols or carbine-like pistols, and to customize firearms for various tactical purposes.

14 Claims, 12 Drawing Sheets

(56) References Cited

U.S. PATENT DOCUMENTS

2005/0229460 A1 10/2005 LaFleur
2006/0150467 A1 7/2006 Poulin et al.
2009/0071053 A1 3/2009 Thomele et al.
2011/0030258 A1* 2/2011 Fistikchi ..... F41C 23/22 42/1.06
2014/0182182 A1 7/2014 Adcock, Jr.
2014/0352190 A1 12/2014 Voigt
2015/0000171 A1 1/2015 Roberts
2015/0159974 A1 6/2015 Cole
2015/0247698 A1 9/2015 Bosco
2015/0300773 A1 10/2015 Oz
2015/0308790 A1 10/2015 Gravelle et al.
2016/0084610 A1 3/2016 Wood et al.
2016/0153743 A1 6/2016 Hawkins
2016/0273876 A1 9/2016 Barfoot et al.
2017/0191769 A1 7/2017 Martindill et al.
2017/0241738 A1 8/2017 Simpson
2018/0010880 A1 1/2018 Porat
2018/0073835 A1 3/2018 Saltzman
2018/0202737 A1 7/2018 Ferguson
2018/0216904 A1* 8/2018 Noonan ..... F41C 23/22
2018/0356174 A1 12/2018 Balenger
2019/0033025 A1 1/2019 Wolf et al.
2019/0049203 A1 2/2019 Song
2019/0107366 A1 4/2019 Reavis, III
2019/0204033 A1 6/2019 Fellows et al.
2019/0226797 A1 7/2019 Faifer
2019/0257613 A1 8/2019 Burkhart, III et al.
2019/0323795 A1 10/2019 Zimmer
2019/0346239 A1 11/2019 Zimmerman
2020/0173752 A1 6/2020 Wolf et al.
2020/0191508 A1 6/2020 Satzinger et al.
2020/0191520 A1 6/2020 Kielsmeier et al.
2020/0217604 A1 7/2020 Borges et al.
2020/0292274 A1 9/2020 Marelin

* cited by examiner

HYBRID PISTOL FRAME KIT FOR RECEIVING FIREARM PARTS AND ACCESSORIES

BACKGROUND OF THE DISCLOSURE

Modifying various firearms with new or different barrels, grips, and the like is well known. However, pieces and parts usually are removed and replaced using off-the-shelf (OTS) or original equipment from the manufacturer (OEM parts). An OEM metal pistol frame, for instance, might be replaced with another OEM frame. The new frame can receive existing pistol components such as a slide, a barrel, and a magazine, and the general function and appearance of the pistol will remain substantially unchanged.

What is needed in the firearms industry is a system and process for customizing firearms to expand their functionality, including converting a pistol into a rifle or providing a pistol brace-equipped handgun.

BRIEF SUMMARY OF THE DISCLOSURE

The present disclosure is directed in general to systems and methods that re-purpose existing pistol components to personalize firearms or to customize firearms for various tactical purposes. Generally, the present disclosure offers a prefabricated synthetic frame, also known as a "Ghost Gun" or "80% receiver," that is ultimately processed by an end user to receive existing or new firearm components to form a hybrid firearm.

In one embodiment according to the disclosure, a prefabricated pistol frame may include a frame having a receiving cavity formed therein being configured for installation of a plurality of pistol components; a front grip formed below the receiving cavity, the front grip including a first magazine well or compartment formed therein; a rear grip formed below the receiving cavity proximate the front grip, the rear grip including a second magazine well or compartment formed therein; and an extension formed proximate the rear grip, the extension being configured for receiving an accessory. In this embodiment, the frame may be formed from a polymer material with a trigger guard disposed between the front grip and the rear grip, and the pistol components may include a barrel, a slide, and other known pistol parts.

The extension in this prefabricated pistol frame embodiment may be a substantially D-shaped mount equipped to receive the accessory, which may be a foldable or standard stock. More particularly, the extension may be equipped to receive a Picatinny rail ("pic rail") to which the accessory can be mounted.

In another embodiment, a prefabricated pistol frame blank may include a housing having a receiving cavity disposed therein for receiving a plurality of pistol components; a polymer block formed proximate the receiving cavity and being configured for aftermarket removal to install the plurality of pistol components; a forward grip having a magazine storage formed therein, the forward grip depending from the housing; a rear grip having a magazine well or compartment formed therein, the rear grip depending from the housing proximate the forward grip; and a brace interface depending from the rear grip, the brace being configured to receive a shoulder stock. The housing may be formed from a polymer material, and the pistol components may include a barrel, a slide and other pistol components. In this example, the shoulder stock may be fixed or foldable, and the brace interface may be equipped to receive a pic rail to which the shoulder stock can be mounted.

In another exemplary embodiment according to the disclosure, a method of forming a hybrid firearm may include prefabricating a pistol frame blank with a detachable block in which the pistol frame blank may be made of polymer material and may include a housing having a receiving cavity disposed therein for receiving a plurality of pistol components; a forward grip having a magazine storage formed therein; a rear grip having a magazine well or compartment formed therein; and a brace interface depending from the rear grip, the brace being configured to receive an accessory. The method may further include removing the detachable block from the pistol frame blank to expose the receiving cavity; and installing the plurality of pistol components in the receiving cavity.

The method of forming a hybrid firearm may further include mounting the accessory to the brace interface, attaching a pic rail to the brace interface, and mounting the accessory, such as a shoulder stock or brace, to the pic rail. Still further, the method may include attaching a pic rail to the brace interface and mounting the accessory to the pic rail.

Additional objects and advantages of the present subject matter are set forth in, or will be apparent to, those of ordinary skill in the art from the description herein. Also, it should be further appreciated that modifications and variations to the specifically illustrated, referenced, and discussed features, processes, and elements hereof may be practiced in various embodiments and uses of the disclosure without departing from the spirit and scope of the subject matter. Variations may include, but are not limited to, substitution of equivalent means, features, or steps for those illustrated, referenced, or discussed, and the functional, operational, or positional reversal of various parts, features, steps, or the like. Those of ordinary skill in the art will better appreciate the features and aspects of the various embodiments, and others, upon review of the remainder of the specification.

BRIEF DESCRIPTION OF THE DRAWINGS

A full and enabling disclosure of the present subject matter, including the best mode thereof directed to one of ordinary skill in the art, is set forth in the specification, which refers to the appended figures, wherein.

DETAILED DESCRIPTION OF THE DISCLOSURE

Figure 1:
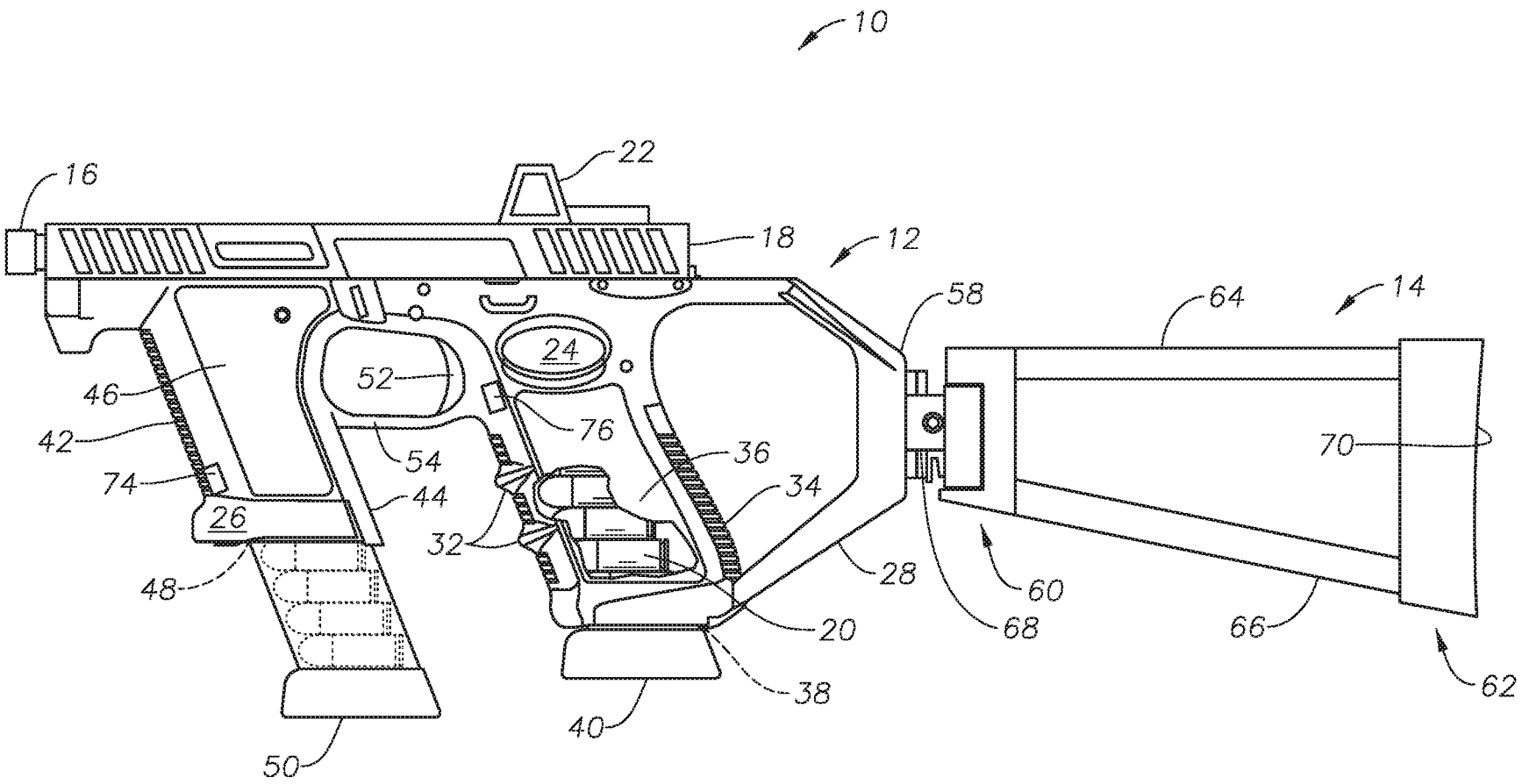
FIG. 1 is a left-side, partially cutaway, elevational view of an embodiment of a hybrid pistol frame according to the disclosure shown in an intended use condition.

As required, detailed embodiments are disclosed herein; however, the disclosed embodiments are merely exemplary and may be embodied in various forms. Therefore, specific structural and functional details disclosed herein are not to be interpreted as limiting, but merely as a basis for the claims and as a representative basis for teaching one skilled in the art to variously employ the exemplary embodiments of the present disclosure, as well as their equivalents.

Unless defined otherwise, all technical and scientific terms used herein have the same meaning as is commonly understood by one of ordinary skill in the art to which this disclosure belongs. In the event that there is a plurality of definitions for a term or acronym herein, those in this section prevail unless stated otherwise.

"Ghost gun," "80% receiver," or "Blank" means castings or machined, molded or other manufactured bodies that are not firearms in that they are not sufficiently complete to be classified as firearm frames or receivers under the Gun Control Act of 1968 (GCA), 18 U.S.C. Chapter 44.

Wherever the phrases "for example," "such as," "including," and the like are used herein, the phrase "and without limitation" is understood to follow unless explicitly stated otherwise. Similarly, "an example," "exemplary," and the like are understood to be non-limiting.

The term "substantially" allows for deviations from the descriptor that do not negatively impact the intended purpose. Descriptive terms are understood to be modified by the term "substantially" even if the word "substantially" is not explicitly recited.

The term "about" when used in connection with a numerical value refers to the actual given value, and to the approximation to such given value that would reasonably be inferred by one of ordinary skill in the art, including approximations due to the experimental and or measurement conditions for such given value.

Unless the context clearly requires otherwise, throughout the description and the claims, the words "comprise", "comprising", and the like are to be construed in an inclusive sense as opposed to an exclusive or exhaustive sense; in the sense of "including, but not limited to."

The terms "comprising" and "including" and "having" and "involving" (and similarly "comprises", "includes," "has," and "involves") and the like are used interchangeably and have the same meaning. Specifically, each of the terms is defined consistent with the common United States patent law definition of "comprising" and is therefore interpreted to be an open term meaning "at least the following," and is also interpreted not to exclude additional features, limitations, aspects, et cetera. Thus, for example, "a device having components a, b, and c" means that the device includes at least components a, b, and c. Similarly, the phrase: "a method involving steps a, b, and c" means that the method includes at least steps a, b, and c.

Where a list of alternative component terms is used, e.g., "a structure such as 'a', 'c', 'd' or the like", or "a" or b", such lists and alternative terms provide meaning and context for the sake of illustration, unless indicated otherwise. Also, relative terms such as "first," "second," "third," "front," and "rear" are intended to identify or distinguish one component or feature from another similar component or feature, unless indicated otherwise herein.

The various embodiments of the disclosure and/or equivalents falling within the scope of present disclosure overcome or ameliorate at least one of the disadvantages of the prior art.

Detailed reference will now be made to the drawings in which examples embodying the present subject matter are shown. The detailed description uses numerical and letter designations to refer to features of the drawings. The drawings and detailed description provide a full and written description of the present subject matter, and of the manner and process of making and using various exemplary embodiments, so as to enable one skilled in the pertinent art to make and use them, as well as the best mode of carrying out the exemplary embodiments. The drawings are not necessarily to scale, and some features may be exaggerated to show details of particular components. Thus, the examples set forth in the drawings and detailed descriptions are provided by way of explanation only and are not meant as limitations of the disclosure. The present subject matter thus includes any modifications and variations of the following examples as come within the scope of the appended claims and their equivalents.

Turning now to FIG. 1, an exemplary hybrid pistol is designated broadly by the element number 10. The hybrid pistol 10 may include a prefabricated frame 12 with a detachable butt or shoulder stock 14. In this example, the fully assembled hybrid pistol 10 includes a barrel 16, a slide 18, bullets or ammunition 20, and a rear targeting sight 22 (which could be a red dot/laser targeting system as shown or OEM iron sights). Not shown but included with the barrel 16 and the slide 18 as known to those of ordinary skill in the art is an internal firing assembly, which may include a barrel bushing, barrel link, link pin, disconnector, ejector, ejector pin, extractor, firing pin, firing pin plunger, firing pin spring, firing pin stop, hammer, hammer pin, hammer strut, hammer strut pin, magazine catch(es), springs and related components, plunger and related components, recoil spring, recoil spring guide, recoil spring plug, safety lock, safety lock plunger, sear, sear pin, sear spring, slide components, trigger assembly and related mechanisms.

The prefabricated frame 12 in FIG. 1 may be molded, printed, or cast from polymers such as polypropylenes, a high density polyethylene (HDPE), or other durable materials, may include a rear hand grip 24, a front hand grip 26, and a brace or stock interface 28, which may also be referred to herein as an extension or an interface. A process for making the prefabricated frame 12 and placing it in a condition to receive pistol parts to become operable is explained in greater detail below.

FIG. 1 further shows that the rear hand grip 24 may include a front strap 32 (also referred to herein as a first, front hand rest), a back strap 34 (also referred to herein as a first, rear hand rest), and nonslip side panels or grip material 36. Here, a trigger 52 is protected by a trigger guard 54, and the rear hand grip 24 has a first aperture or magazine compartment or well 38 into which a first or operating magazine 40 is inserted, which, when the magazine 40 is emptied of ammunition 20, can be released by a magazine release button 76.

Also in the exemplary embodiment of FIG. 1, the front hand grip 26 may include a front strap 42 (also referred to herein as a second, front hand rest), a back strap 44 (also referred to herein as a second, rear hand rest), and nonslip side panels or grip material 46. Here, the front hand grip 26 has a second aperture or magazine well 48 into which a second or spare magazine 50 is inserted with ammunition (shown in phantom). When the first magazine 40 is out of ammunition and the second magazine 50 is needed, the magazine 50 can be released by a magazine release button 74 to replace the first magazine 40. As this example further shows, the front hand grip 26 is relatively shorter than the rear hand grip 24, and the spare magazine 50 extends below the operating magazine 40. In other words, the spare magazine 50 does not extend as far into the front hand grip 26 as the magazine 40 extends into the rear hand grip 24. This arrangement makes the hybrid pistol 10 easier to grip and utilize, for instance, in close combat situations. However, the lengths of the front and rear hand grips 24, 26 may vary and are not limited to this example.

With continued reference to FIG. 1, the stock interface 28 briefly introduced above is shown extending from the rear hand grip 24 and terminates at a swivel attachment point 58, which may be or may include a Picatinny rail ("Pic rail") interface. In this example, the brace 28 is unitarily formed in a "D" shape with the rear hand grip 24, but it is not limited to this configuration. For instance, the brace interface 28 may be shaped other than as shown, made smaller or larger, and/or it could be formed separately from the rear hand grip 24 and made attachable/detachable in order to be substituted with a different shaped brace 28 for various applications.

Also shown in FIG. 1, the shoulder stock 14, which attaches to the interface 58, e.g., by the Pic rail, has a proximal end 60, a distal end 62 with a shoulder rest or butt plate 70, an upper bar 64, and a lower bar 66 or a pistol brace for one hand shooting. Notwithstanding this example, only one bar might be utilized, or a solid shoulder stock may be used according to a desire of an individual user. Still further, user preferences can dictate overall length, material, and weight of the shoulder stock 14 and/or brace interface 28. In this example, the shoulder stock 14 also includes a swivelable Pic rail assembly 68 at the proximal end 60 to connect the shoulder stock 14 and/or brace interface 28 to the interface 58. As explained below, when not in use, the assembly 68 permits the stock 14 to be folded toward and against the frame 12 for storage, for compact carrying, and the like. Those skilled in the art will understand that the stock 14 and the brace interface 28 shown here by way of example do not have to be foldable.

Figure 2:
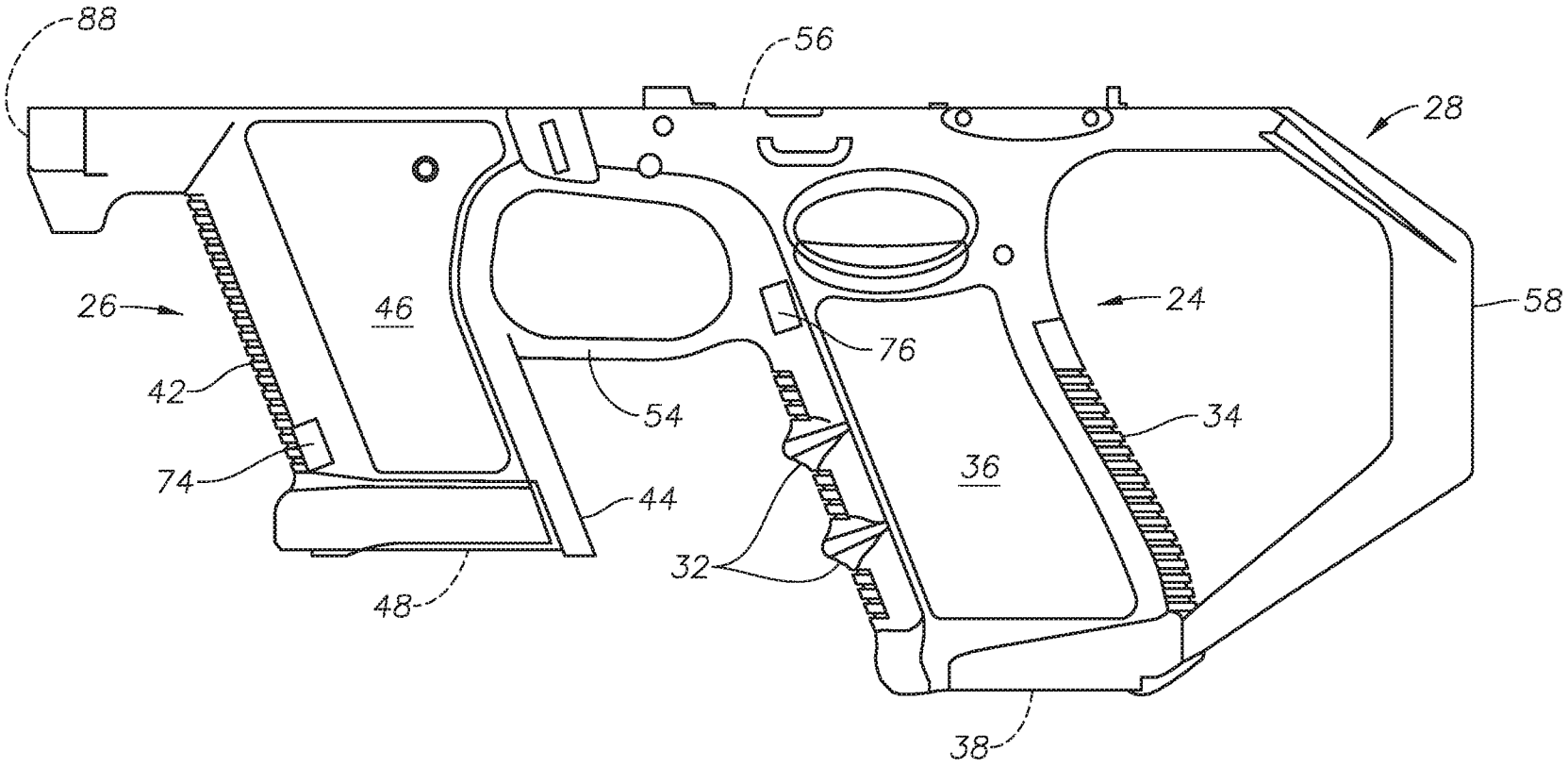
FIG. 2 is an elevational view of the hybrid pistol frame as in FIG. 1 shown without OEM components installed.

With reference now to FIG. 2, the prefabricated frame 12 is shown most clearly. Specifically, the rear hand grip 24, the front hand grip 26, the brace interface 28, and the trigger guard 54 are shown without original pistol components or hardware such as the barrel 16 and the slide 18 as shown in FIG. 1. Again, features of the rear hand grip 24 may include the front strap 32, which may include various indentations, ridges, or raised features for better finger grip, the back strap 34, and the side panels or non-slip material 36. Similarly, the front hand grip 26 as introduced above may include the front strap 42, the back strap 44, and the side panels or non-slip material 46. Here, too, a receiving cavity 56 is shown for receiving the slide 18 which houses the barrel 16 (FIG. 1) and other pistol components. The receiving cavity 56 terminates at a terminal end 88 from which the barrel 16 may extend as in FIG. 1.

Figure 3:
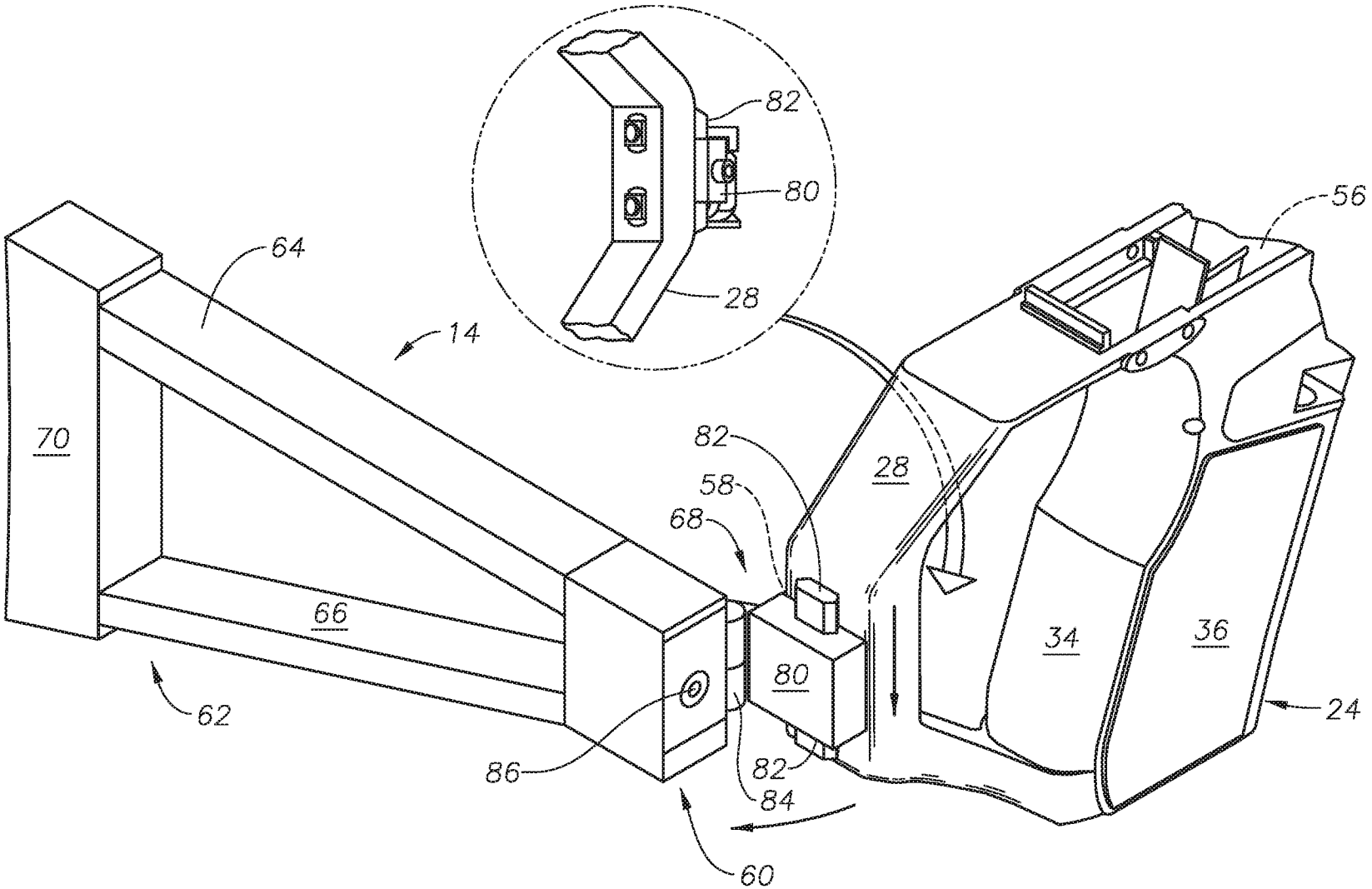
FIG. 3 is a perspective, partial view of a brace shown swiveled to an open position and attached to a portion of the hybrid pistol frame as in FIG. 1, particularly showing in inset a partially cutaway attachment arrangement.

FIG. 3 most clearly shows the swivelable Pic rail assembly 68 connecting the shoulder stock 14 to the brace interface 28. Here, the assembly 68 may include a detachable connector 80 at the proximal end 60 of the shoulder stock 14 or pistol brace 28 with depressible release bars or buttons 82 for connecting and disconnecting interlock protrusions (not shown) from the interface 58. The detachable connector 80 is shown being attached by a downward facing arrow into the picatinny rail 68 which connects to the interface 58 (see partial inset). As further shown, the assembly 68 may include a hinge or swivel 84 and a magnet or locking device 86 to lock the stock 14 in alignment with the connector 80. As noted above and as indicated by a left-facing curved arrow in FIG. 3, when the locking device 86 is released from the connector 80, the butt plate 70 at the distal end 62 of the stock 14 or pistol brace (including its upper and lower bars 64, 66) can be swiveled and folded toward the rear handle 24, which shows the back strap 34 and the non-slip material 36, for compact storage or carrying.

Figure 4:
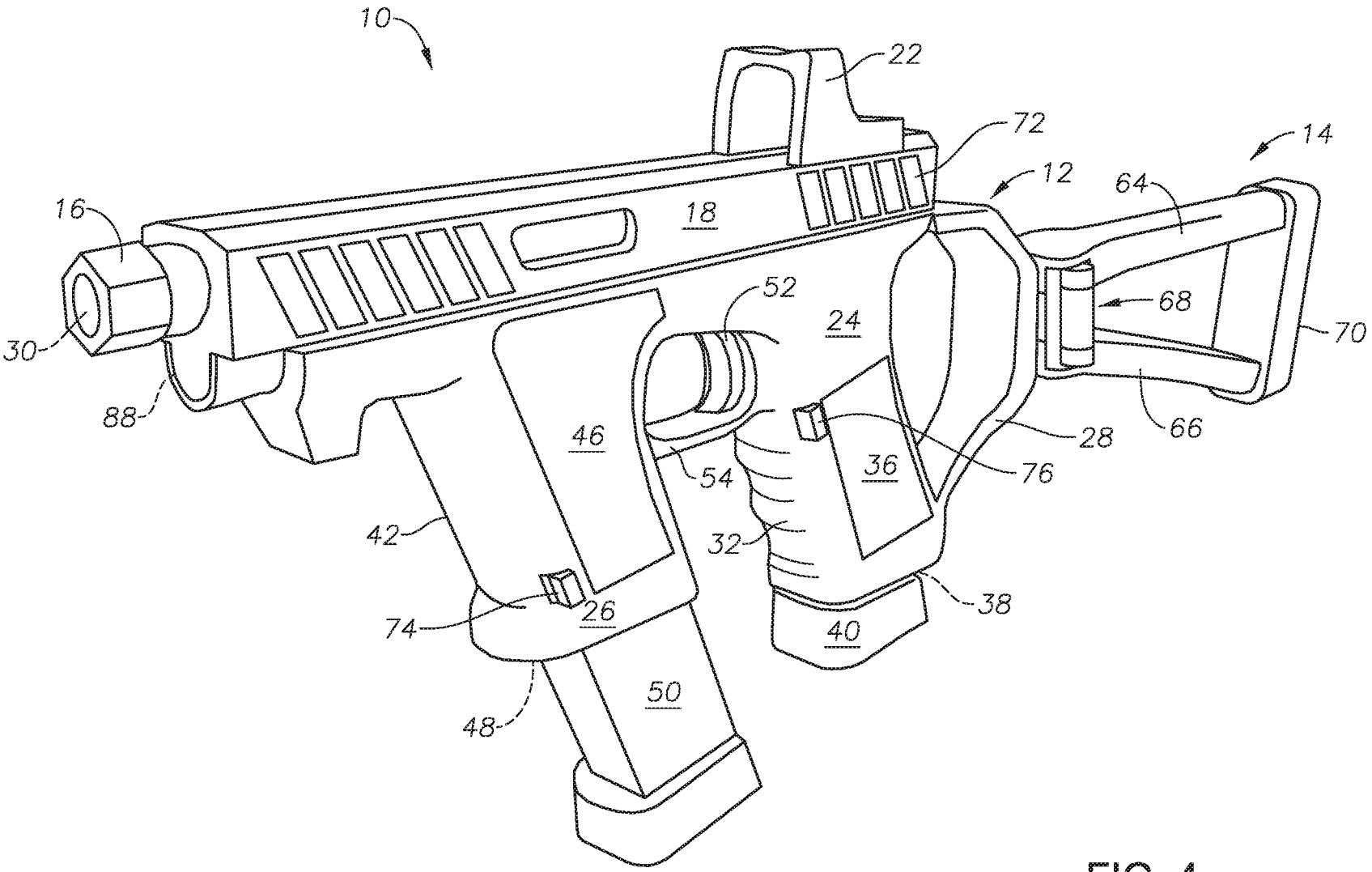
FIG. 4 is a front perspective view of the hybrid pistol frame as in FIG. 1.

FIG. 4 shows the hybrid pistol 10 and its prefabricated frame 12 and shoulder stock 14 from another perspective. As introduced above, the hybrid pistol 10 includes the barrel 16, which most clearly shows a muzzle 30, and the slide 18, and the rear sight 22. Here, the barrel 16 projects from the terminal end 88. Additional details of the rear hand grip 24, the front hand grip 26, and the stock or brace interface 28 of the frame 12 are also shown. Specifically, the brace 28 extends from the rear hand grip 24, which includes the rear strap 32, the back strap 34, and the side panels 36. The operating magazine 40 is inserted in the magazine well 38 of the rear hand grip 24, and as noted above, when the magazine 40 is empty, it can be released by the magazine release button 76.

Also shown in FIG. 4, the front hand grip 26 includes the front strap 42, the back strap 44, and the nonslip panels 46, and the trigger 52 is most clearly shown inside of the trigger guard 54. Here again, the spare magazine 50 is stored in the magazine well 48 of the front hand grip 26, and the second magazine 50 can be released by the ejector button 74 to replace the first magazine 40 when needed.

FIG. 4 further shows the shoulder stock 14 with its upper and lower bars 64, 66 and butt plate 70 in an extended position with the assembly 68 rotated to a fully open position as described above. Further, grip material or ridges 72 may be attached to or molded in the slide 18, which can be useful to better grip and pull the slide 18, for instance, under wet conditions.

Figure 5:
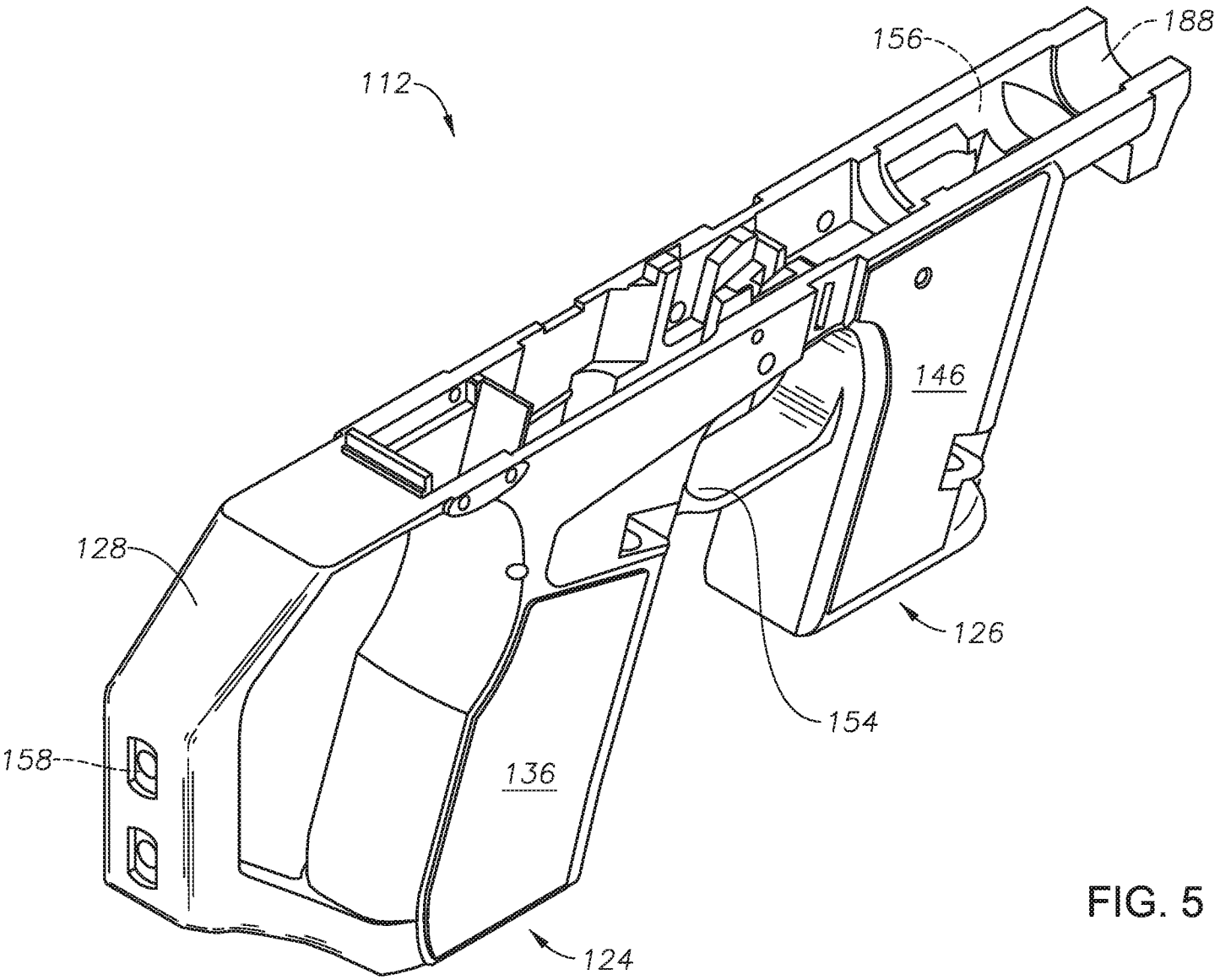
FIG. 5 is a top right perspective view of a hybrid pistol frame according to another aspect of the disclosure.

Turning now to FIG. 5, a prefabricated frame 112 is shown with a rear hand grip 124, a front hand grip 126, a brace 128, and a trigger guard 154. The rear hand grip 124 may include side panels or non-slip material 136, and the front hand grip 126 may include side panels or non-slip material 146. An exemplary receiving cavity 156 is provided to receive pistol components such as frame internals, a barrel, and a slide (not shown). The barrel would also rest in and possibly extend from a terminal end 188 of the cavity 156 as shown. Here, too, one or more interfaces 158 are provided on the brace 128, into which, in this example, projection devices (not shown) from a shoulder stock may be snap-fitted to convert the pistol frame 112 into a shoulder-fired weapon.

Figure 6:
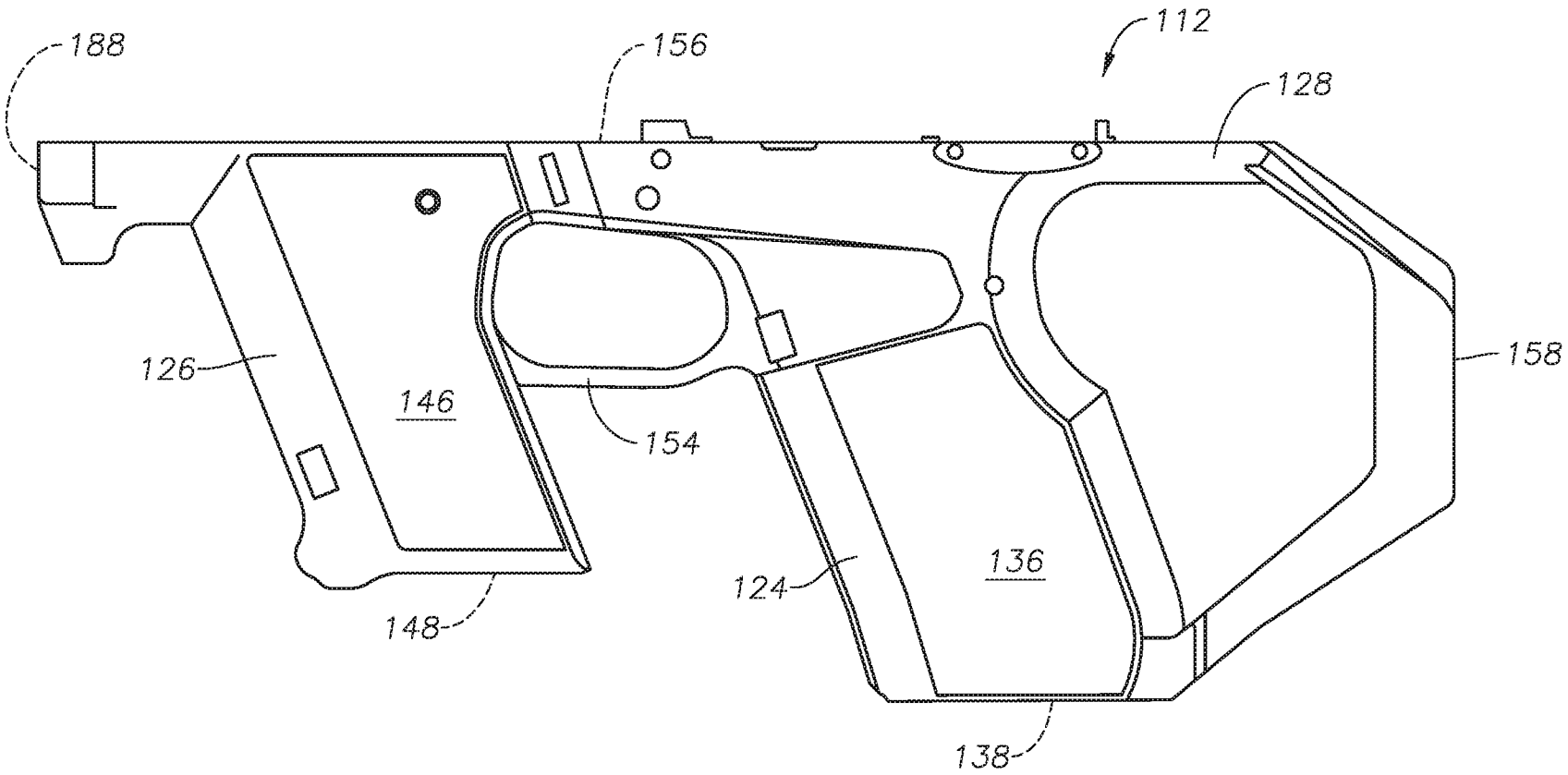
FIG. 6 is a left-side elevational view of the hybrid pistol frame as in FIG. 5.
Figure 7:
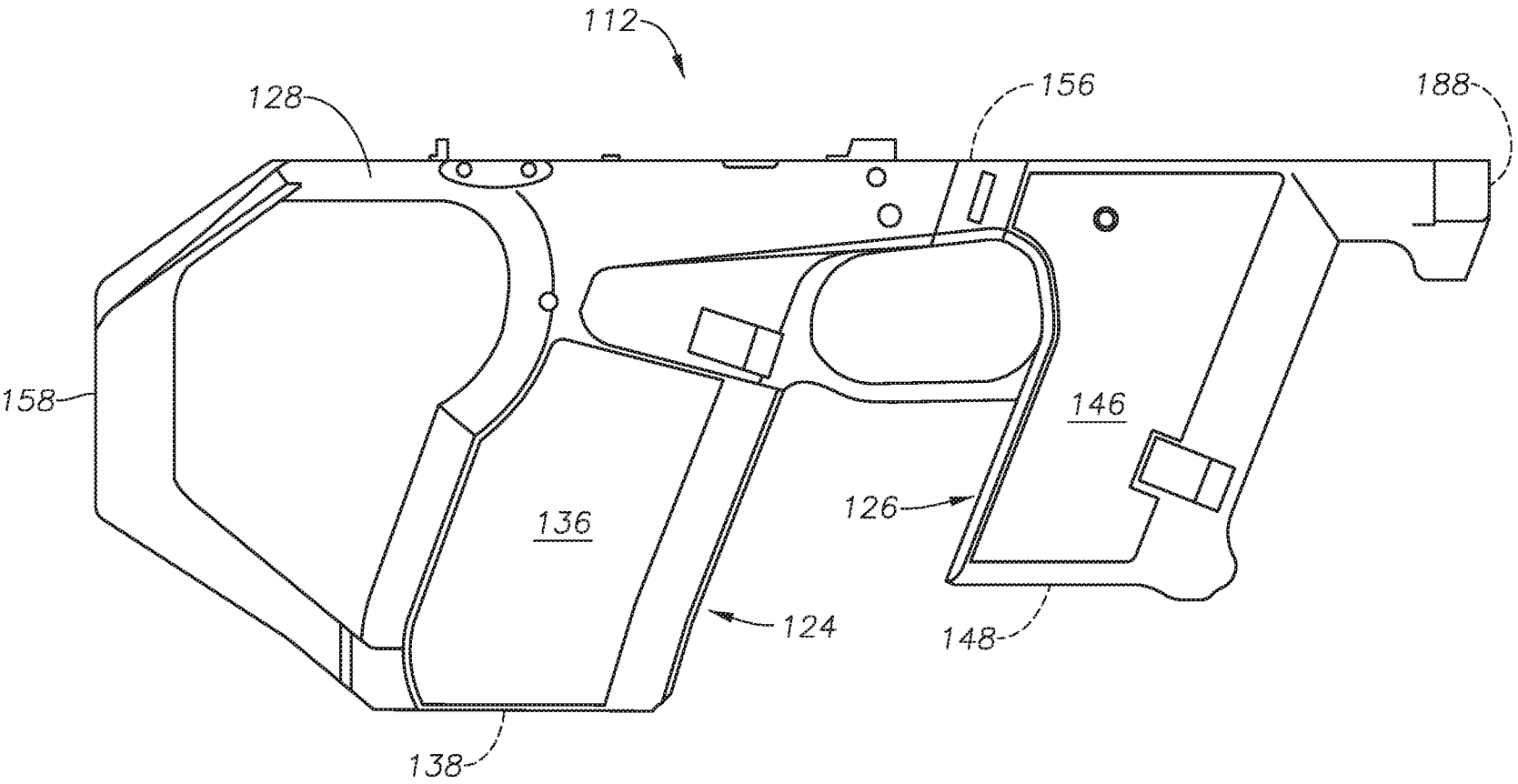
FIG. 7 is a right-side elevational view of the hybrid pistol frame as in FIG. 5.

FIGS. 6 and 7, respectively, show the prefabricated frame 112 from a left side and from a right side, including the rear hand grip 124, a front hand grip 126, a stock or brace interface 128, and a trigger guard 154. The rear hand grip 124 may include side panels or non-slip material 136, and the front hand grip 126 may include side panels or non-slip material 146. The exemplary receiving cavity 156 with its terminal end 188 is provided to receive pistol components as stated above, and one or more interfaces 158 are provided on the brace 128 to receive a picatinny rail which connects the stock or other accessory (not shown). Also shown, a magazine well 138 of the rear hand grip 124 is provided to hold a working magazine (not shown) while a magazine well 148 of the front hand grip 126 is provided to carry a spare magazine (not shown).

Figure 9:
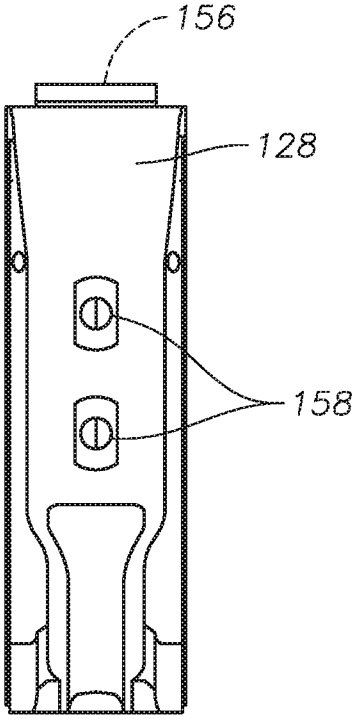
FIG. 9 is a rear elevational view of the hybrid pistol frame as in FIG. 5.
Figure 8:
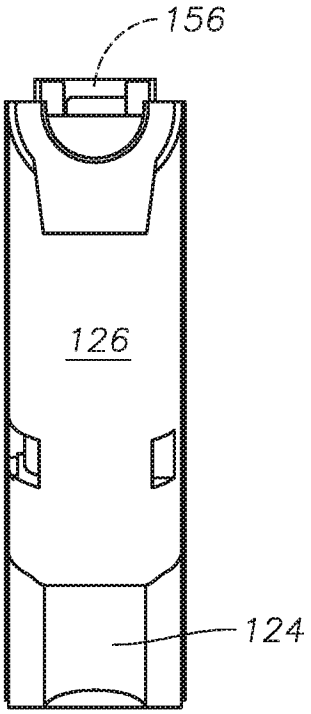
FIG. 8 is a front elevational view of the hybrid pistol frame as in FIG. 5.

FIG. 8 is a front view of the prefabricated frame 112 in which portions of the rear hand grip 124 and the front hand grip 126 can be seen under a portion of the exemplary receiving cavity 156. Similarly, FIG. 9 is a rear view of the prefabricated frame 112 in which a portion of the stock or brace interface 128 with apertures 158 are shown below a portion of the receiving cavity 156. The apertures 158 are cutouts that allow the installation of a pic rail (not shown) whereby the rail fits into the cutouts 158, and a screw or a bolt (see, e.g., inset FIG. 3) placed through it to connecting the picatinny rail.

Figure 10:
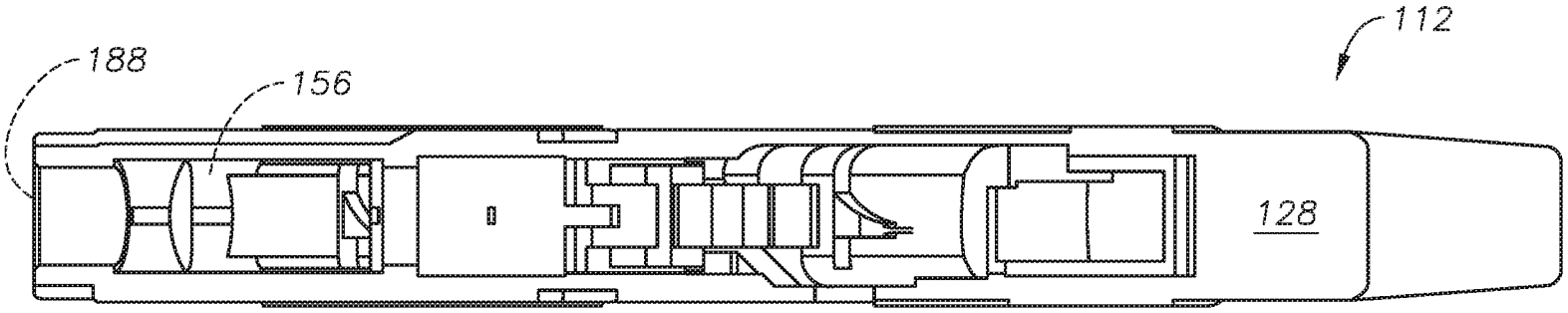
FIG. 10 is a top plan view of the hybrid pistol frame as in FIG. 5.
Figure 11:
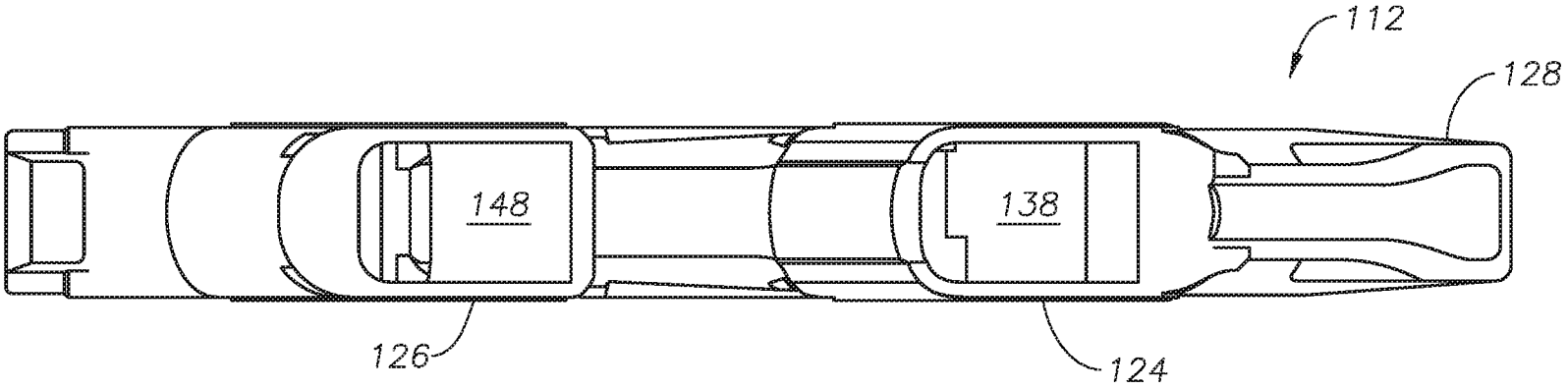
FIG. 11 is a bottom plan view of the hybrid pistol frame as in FIG. 5.

FIG. 10 is a top down view of the prefabricated frame 112 in which portions of the stock or brace interface 128 and the receiving cavity 156 and its terminal end 188 are shown, and FIG. 11 is a bottom up view of the prefabricated frame 112 showing portions of the rear and front grips 124, 126 with respective magazine wells 138, 148.

Figure 12:
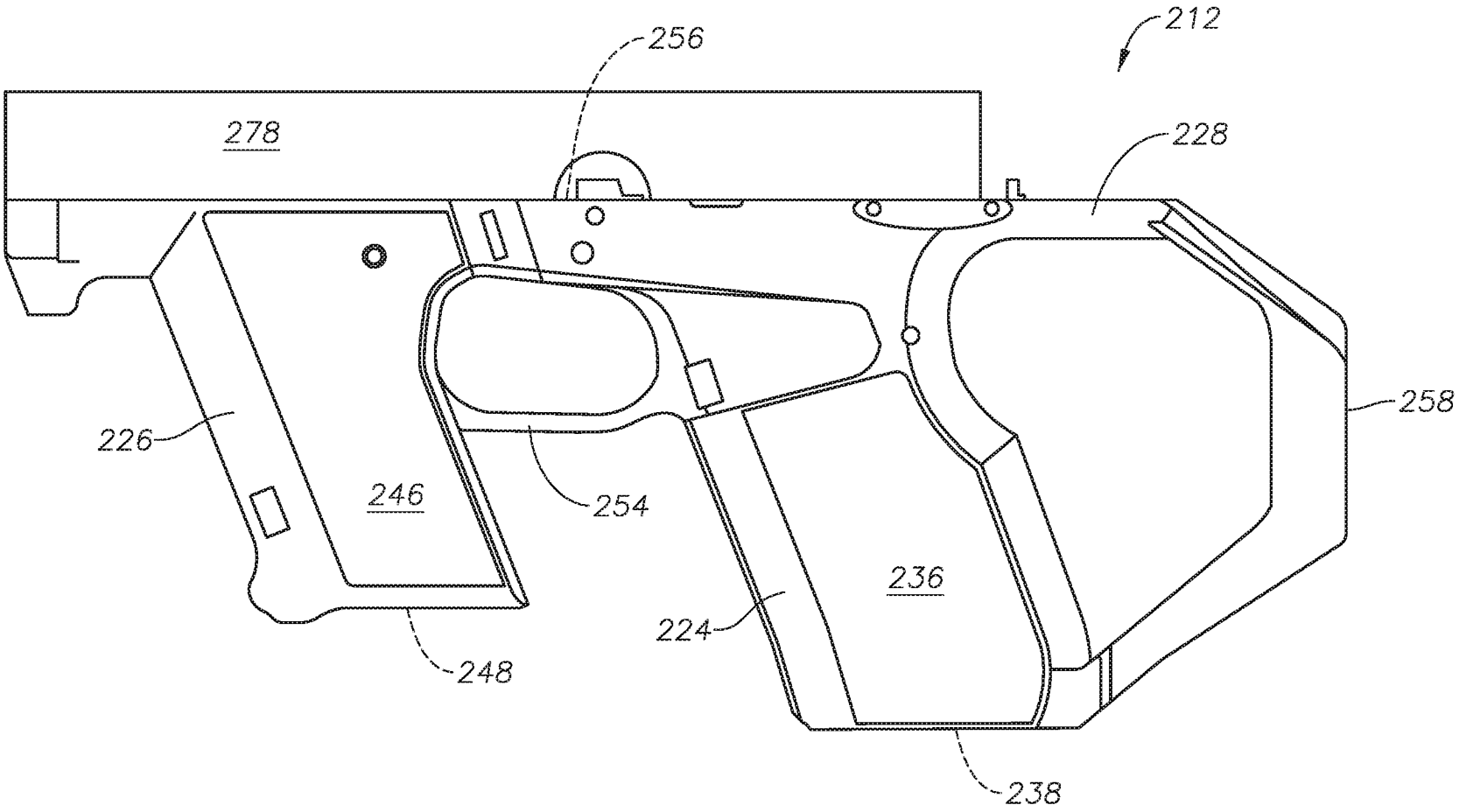
FIG. 12 is a left-side elevational view of a hybrid pistol frame according to another aspect of the disclosure shown in a pre-operational condition.

With reference now to FIG. 12, an exemplary Ghost gun or 80% receiver 212 is shown after a molding or casting process. Here, a rear hand grip 224 with a grip surface 236 and a magazine well 238, a front hand grip 226 with a grip surface 246 and a magazine well 248, and a trigger guard 254 can be seen under a portion of an exemplary receiving cavity 256. The grip surfaces 236, 246 may be molded with the receiver 212 or installed as separate components or panels afterwards. Also shown in this example, a brace 228 with interfaces 258 extend from the rear grip 224, and a cutaway feature or polymer block 278 is molded along a top portion of the receiving cavity 256, which, until removed, prevents installation of a barrel and other pistol components into the cavity 256. The Ghost gun 212 including the block 278 are made from HDPE or other durable, lightweight material.

Figure 13:
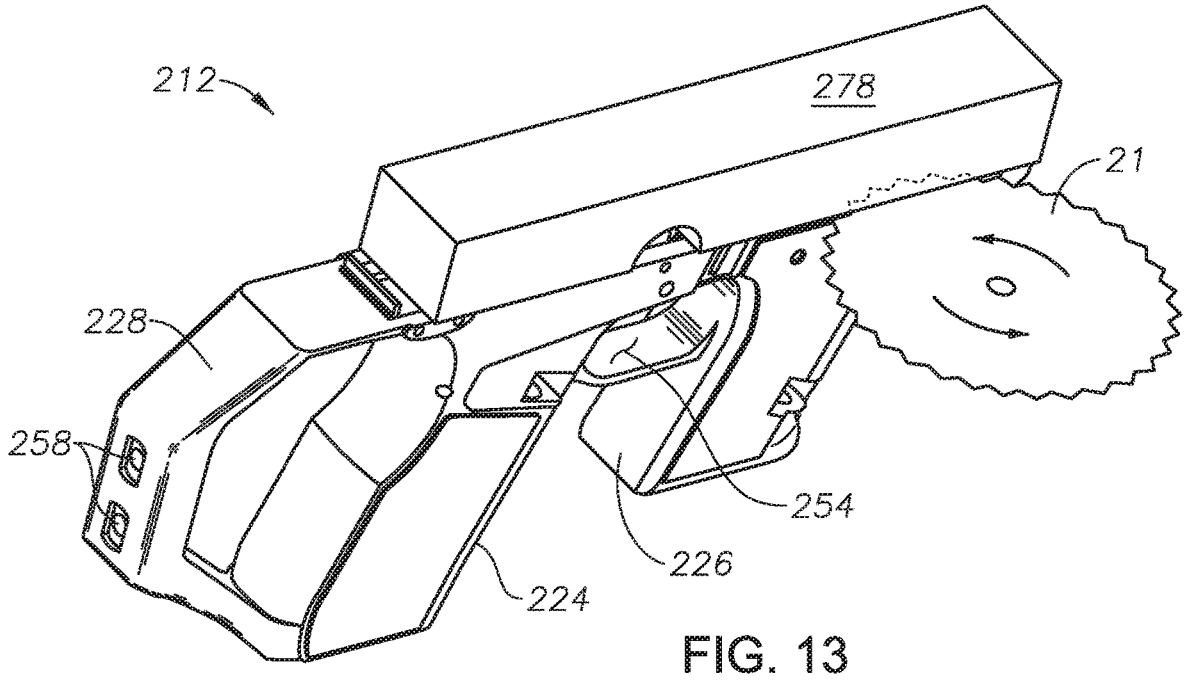
FIG. 13 is a top right perspective view of the hybrid pistol frame as in FIG. 12, particularly showing a step in preparing the hybrid pistol frame for use.

FIG. 13 shows the block 278 being cut away from the Ghost gun 212 using a saw, which is schematically illustrated in operation by the number 21. Here, the rear hand grip 224 and the front hand grip 226, the trigger guard 254, and the brace 228 are separated from the block 278 to prepare the Ghost gun 212 to receive a barrel and other pistol components.

Figure 14:
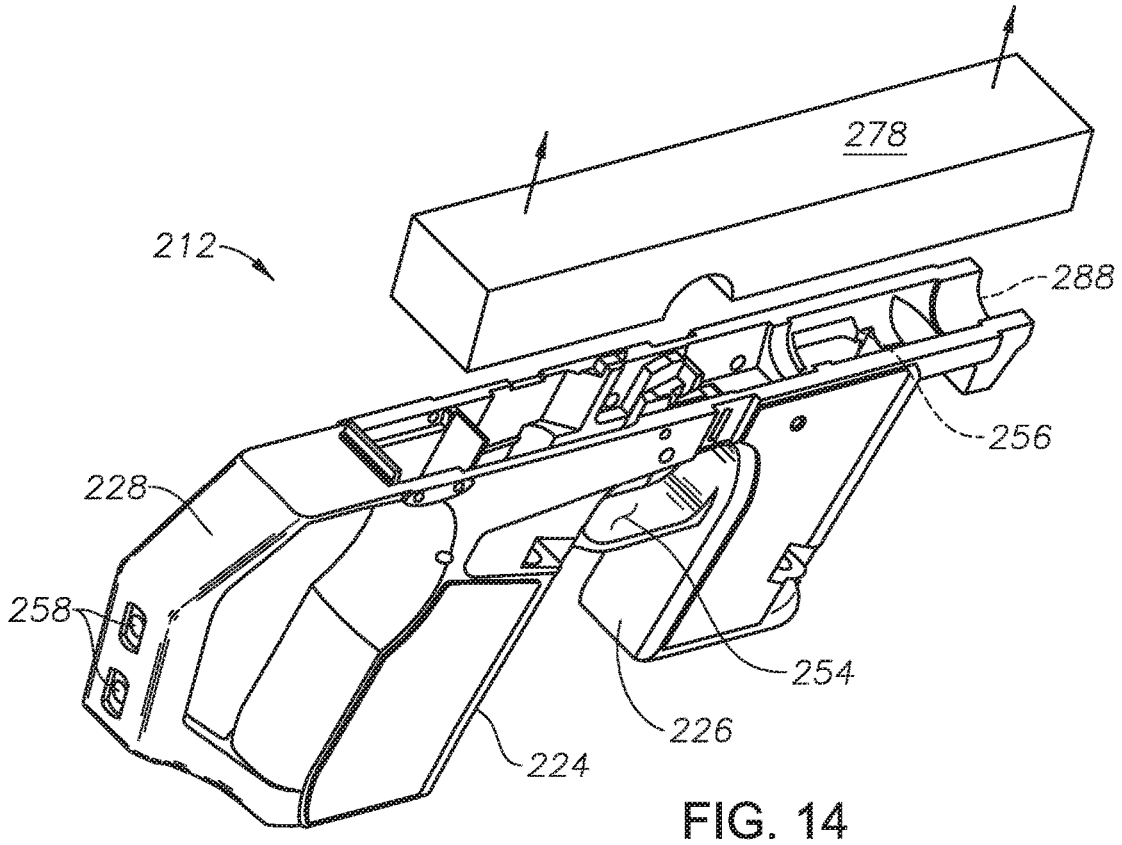
FIG. 14 is a top right perspective view of the hybrid pistol frame as in FIG. 13, showing another step in preparing the hybrid pistol frame for use.

FIG. 14 shows, as indicated by two upwardly directed arrows, that the block 278 has been removed from the Ghost gun 212 to expose a receiving cavity 256 with a terminal end 288 receive the pistol components. The interfaces 258 may be provided on the brace 228 to receive a shoulder stock or other accessories (not shown).

Figure 15:
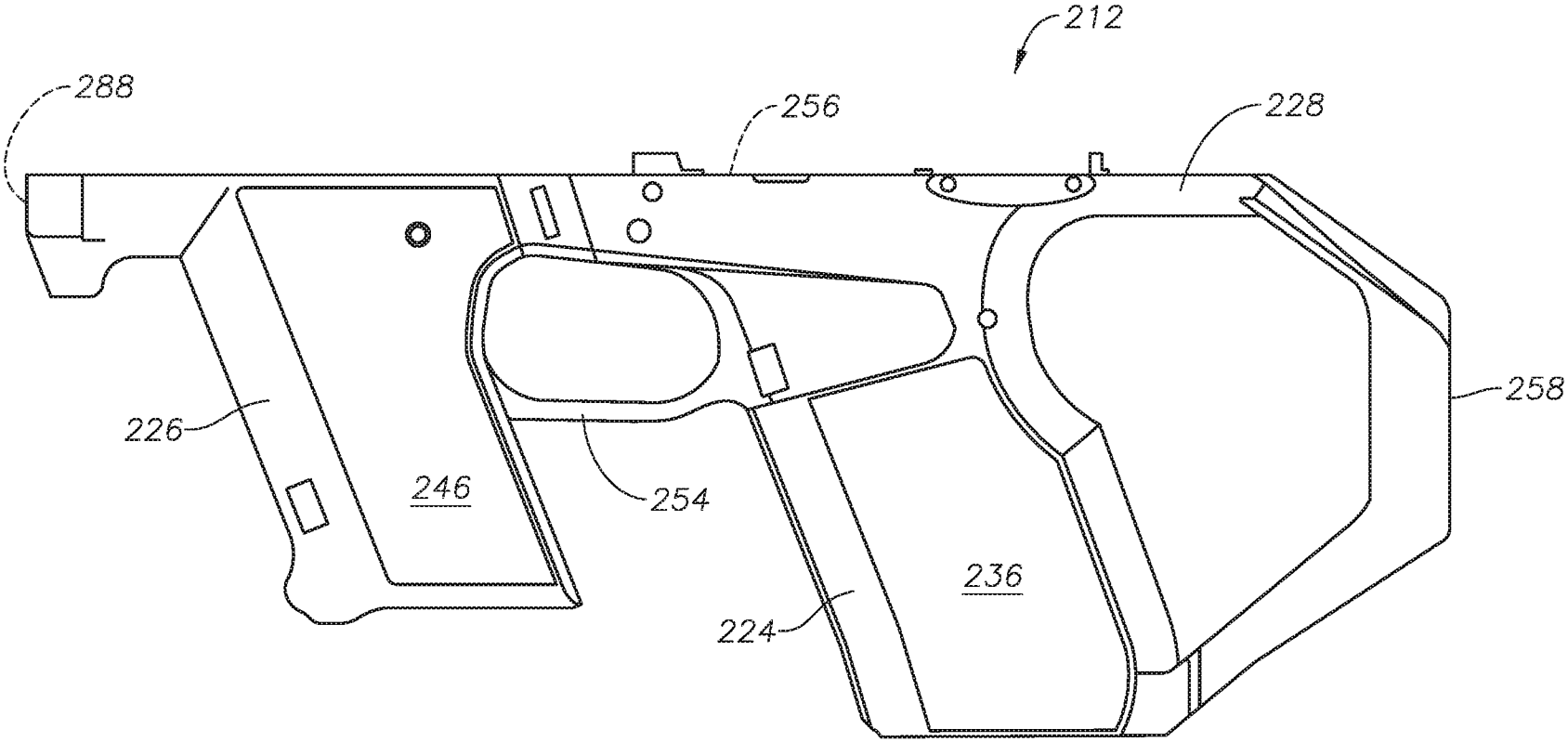
FIG. 15 is a left-side elevational view of the hybrid pistol frame as in FIG. 13, particularly showing the frame ready component installation.

In comparison to FIG. 12, the finished receiver 212 shown in FIG. 15 includes the rear hand grip 224 and its grip surface 236, the front hand grip 226 and its grip surface 246, and a trigger guard 254, over which portions of the receiving cavity 256 and its terminal end 288 reside to receive pistol components as described above. Again, as shown here the brace 228 with interfaces 258 extend from the rear grip 224 to receive a shoulder stock or other accessories.

By way of example and not of limitation, exemplary embodiments as disclosed herein may include but are not limited to:

Embodiment 1

A prefabricated pistol frame comprising: a frame having a receiving cavity formed therein being configured for installation of a plurality of pistol components; a front grip formed below the receiving cavity, the front grip including a first magazine well formed therein; a rear grip formed below the receiving cavity proximate the front grip, the rear grip including a second magazine well formed therein; and an extension formed proximate the rear grip, the extension being configured for receiving an accessory.

Embodiment 2

The prefabricated pistol frame as in embodiment 1, wherein the frame is formed from a polymer material.

Embodiment 3

The prefabricated pistol frame as in embodiments 1 or 2, wherein the plurality of pistol components includes a barrel and a slide.

Embodiment 4

The prefabricated pistol frame as in any of the foregoing embodiments, wherein the extension is a D-shaped mount configured to receive the accessory and wherein the accessory is a foldable stock.

Embodiment 5

The prefabricated pistol frame as in any of the foregoing embodiments, wherein the extension is configured to receive a pic rail, the accessory being configured to mount to the pic rail.

Embodiment 6

The prefabricated pistol frame as in any of the foregoing embodiments, further comprising a trigger guard disposed between the front grip and the rear grip.

Embodiment 7

A prefabricated pistol frame blank comprising: a housing having a receiving cavity disposed therein for receiving a plurality of pistol components; a polymer block formed proximate the receiving cavity and being configured for aftermarket removal to install the plurality of pistol components; a forward grip having a magazine storage formed therein, the forward grip depending from the housing; a rear grip having a magazine well formed therein, the rear grip depending from the housing proximate the forward grip; and a brace interface depending from the rear grip, the brace being configured to receive a shoulder stock.

Embodiment 8

The prefabricated pistol frame blank as in embodiment 7, wherein the housing is formed from a polymer material.

Embodiment 9

The prefabricated pistol frame as in embodiments 7 or 8, wherein the pistol components include a barrel and a slide.

Embodiment 10

The prefabricated pistol frame as in embodiments 7, 8, or 9, wherein the shoulder stock is foldable.

Embodiment 11

The prefabricated pistol frame as in embodiments 7 through 10, wherein the brace interface is configured to receive a pic rail, the shoulder stock being configured to mount to the pic rail.

Embodiment 12

A method of forming a hybrid firearm comprising: prefabricating a pistol frame blank with a detachable block, the pistol frame blank including: a housing having a receiving cavity disposed therein for receiving a plurality of pistol components; a forward grip having a magazine storage formed therein; a rear grip having a magazine well formed therein; and a brace interface depending from the rear grip, the brace being configured to receive an accessory; removing the detachable block from the pistol frame blank to expose the receiving cavity; and installing the plurality of pistol components in the receiving cavity.

Embodiment 13

The method of forming a hybrid firearm as in embodiment 12, wherein the pistol frame blank is made of polymer material.

Embodiment 14

The method of forming a hybrid firearm as in embodiments 12 or 13, further comprising mounting the accessory to the brace interface.

Embodiment 15

The method of forming a hybrid firearm as in embodiments 12, 13, or 14, further comprising attaching a pic rail to the brace interface and mounting the accessory to the pic rail, the accessory being a shoulder stock.

Embodiment 16

The method of forming a hybrid firearm as in any of the embodiments 12 through 15, further comprising attaching a pic rail to the brace interface and mounting the accessory to the pic rail, the accessory being a brace.

While the present subject matter has been described in detail with respect to specific embodiments thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

That which is claimed is:

1. A prefabricated pistol frame, comprising:

a frame having a receiving cavity formed therein being configured for installation of a plurality of pistol components;

a front grip formed below the receiving cavity, the front grip including a first magazine well formed therein;

a rear grip formed below the receiving cavity proximate the front grip, the rear grip including a second magazine well formed therein; and an extension formed proximate the rear grip, the extension being a D-shaped mount configured for receiving an accessory, wherein the accessory is a foldable stock.

2. The prefabricated pistol frame as in claim 1, wherein the frame is formed from a polymer material.

3. The prefabricated pistol frame as in claim 1, wherein the plurality of pistol components includes a barrel and a slide.

4. The prefabricated pistol frame as in claim 1, wherein the extension is configured to receive a pic rail, the accessory being configured to mount to the pic rail.

5. A prefabricated pistol frame blank, comprising:

a housing having a receiving cavity disposed therein for receiving a plurality of pistol components;

a polymer block formed proximate the receiving cavity and being configured for aftermarket removal to install the plurality of pistol components;

a forward grip having a magazine storage formed therein, the forward grip depending from the housing;

a rear grip having a magazine well formed therein, the rear grip depending from the housing proximate the forward grip; and a brace interface depending from the rear grip, the brace being configured to receive a foldable shoulder stock.

6. The prefabricated pistol frame blank as in claim 5, wherein the housing is formed from a polymer material.

7. The prefabricated pistol frame as in claim 5, wherein the pistol components include a barrel and a slide.

8. The prefabricated pistol frame as in claim 5, wherein the brace interface is configured to receive a pic rail, the shoulder stock being configured to mount to the pic rail.

9. A method of forming a hybrid firearm, comprising:

prefabricating a pistol frame blank with a detachable block, the pistol frame blank including:

a housing having a receiving cavity disposed therein for receiving a plurality of pistol components;

a forward grip having a magazine storage formed therein;

a rear grip having a magazine well formed therein; and a brace interface depending from the rear grip, the brace being configured to receive an accessory;

removing the detachable block from the pistol frame blank to expose the receiving cavity; and installing the plurality of pistol components in the receiving cavity, including a trigger guard disposed between the front grip and the rear grip.

10. The method of forming a hybrid firearm as in claim 9, wherein the pistol frame blank is made of polymer material.

11. The method of forming a hybrid firearm as in claim 9, further comprising mounting the accessory to the brace interface.

12. The method of forming a hybrid firearm as in claim 9, further comprising attaching a pic rail to the brace interface and mounting the accessory to the pic rail, the accessory being a shoulder stock.

13. The method of forming a hybrid firearm as in claim 9, further comprising attaching a pic rail to the brace interface and mounting the accessory to the pic rail, the accessory being a brace.

14. A prefabricated pistol frame, comprising:

a frame having a receiving cavity formed therein being configured for installation of a plurality of pistol components;

a front grip formed below the receiving cavity, the front grip including a first magazine well formed therein;

a rear grip formed below the receiving cavity proximate the front grip, the rear grip including a second magazine well formed therein;

a trigger guard disposed between the front grip and the rear grip; and an extension formed proximate the rear grip, the extension being configured for receiving an accessory.

* * * * *